US007390208B1

(12) United States Patent
Sabo

(10) Patent No.: US 7,390,208 B1
(45) Date of Patent: Jun. 24, 2008

(54) CARD CONNECTOR ASSEMBLY HAVING IMPROVED TERMINAL

(75) Inventor: James M. Sabo, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/724,921

(22) Filed: Mar. 16, 2007

Related U.S. Application Data

(63) Continuation-in-part of application No. 11/634,490, filed on Dec. 6, 2006, now Pat. No. 7,338,303.

(51) Int. Cl.
*H01R 11/22* (2006.01)

(52) U.S. Cl. ..... 439/267; 439/260; 439/635

(58) Field of Classification Search ..... 439/260, 439/267, 635
See application file for complete search history.

(56) References Cited

U.S. PATENT DOCUMENTS 3,651,444 A * 3/1972 Desso et al. ..... 439/141
4,118,094 A * 10/1978 Key ..... 439/635
4,303,294 A * 12/1981 Hamsher et al. ..... 439/267
4,468,073 A * 8/1984 Machcinski ..... 439/266
4,478,471 A * 10/1984 Olsson ..... 439/267
4,606,594 A * 8/1986 Grabbe et al. ..... 439/267
5,002,496 A * 3/1991 Fox, Jr. ..... 439/197
6,004,151 A * 12/1999 Hashiguchi ..... 439/260
6,213,804 B1 4/2001 Matsumura
6,618,942 B2 * 9/2003 Beaman et al. ..... 29/854
7,014,487 B2 3/2006 Ishikawa

* cited by examiner

*Primary Examiner*—Briggitte R. Hammond
*Assistant Examiner*—Larisa Z Tsukerman
(74) *Attorney, Agent, or Firm*—Wei Te Chung

(57) ABSTRACT

A card connector assembly (100) for insertion of an electronic card (5), includes an insulative housing (1) defining therein a slot (11) and a number of passageways (131) communicating with the slot, and a number of terminals (2) retained in the passageways. Each terminal includes a contact portion (21) exposed in the slot for contacting with the electronic card, and a deformable resilient beam (22) having a depressible portion (221) away from the contact portion. The depressible portions are outwardly depressed due to an insertion of the electronic card, and are inwardly relaxed due to an extraction of the electronic card.

8 Claims, 6 Drawing Sheets

CARD CONNECTOR ASSEMBLY HAVING IMPROVED TERMINAL

CROSS-REFERENCE TO RELATED APPLICATIONS

This patent application is a continuation-in-part of a U.S. patent application Ser. No. 11/634,490, filed on Dec. 6, 2006, now U.S. Pat. No. 7,338,303 and entitled "CARD CONNECTOR ASSEMBLY HAVING CARRIAGE COMPONENT", which is invented by the same inventor as this patent application and assigned to the same assignee with this application.

BACKGROUND OF THE INVENTION

1. Field of the Invention

The present invention relates to a card connector assembly, and particularly to a card connector assembly detachably receiving an electronic card.

2. Description of Related Art

A connector described in U.S. Pat. No. 6,213,804 was issued on Apr. 10, 2001. The connector for receiving a semiconductor comprises a housing defining an insertion slot for insertion of the semiconductor, a plurality of terminals assembled lengthwise along opposite sides of the insertion slot, and a driving mechanism. The driving mechanism comprises a carriage component and a spring mounted below the carriage component for upholding the carriage component and supporting a movement of the carriage component. The terminal comprises a strip-like body portion, a contact portion formed on one end of the body portion for contacting with the semiconductor, and a tail portion formed at the other end of the body portion for soldering onto a circuit board. The contact portions of the terminals are forced to spread outwardly for permitting an insertion of the semiconductor.

A connector described in U.S. Pat. No. 7,014,487 was issued on Mar. 21, 2006. The connector adapted for receiving a circuit board comprises an insulative housing, a slider having an inclined face, two rows of terminals assembled to the slider, and a lever adapted for upwardly moving the slider. Each terminal comprises a contact portion for contacting with the circuit board and an end portion slidable on the inclined face of the slider. When the slider is inserted downwardly into the insulative housing, the end portions of the terminals move downwardly along the inclined face. When the circuit board is pushed downwardly between two rows of the terminals, the contact portions of the terminals come to contact with the printed circuit. The circuit board is therefore fully inserted in the connector. When the slider is actuated upwardly by the lever, the end portions of the terminals climb up the inclined face to space the contact portions away from the circuit board. The circuit board is thereby withdrawn from the connector.

The contact portions of the terminals are forced to spread outwardly for permitting the insertion or the withdrawal of the semiconductor/circuit board. When the semiconductor/circuit board is inserted repeatedly, the connector terminals' conductive plating would experience excessive wear, resulting in unreliable electrical engagement with the inserted semiconductor/circuit board. Further more, such a terminal is nondurable for mating cycles exceeding 250 cycles.

Hence, an improved card connector assembly is required to overcome the above-mentioned disadvantages of the related art.

SUMMARY OF THE INVENTION

An object of the present invention is to provide a card connector assembly comprising a durable terminal having a reliable engagement with an electronic card.

To achieve the aforementioned objects, a card connector assembly for insertion of an electronic card comprises an insulative housing defining therein a slot and a plurality of passageways communicating with the slot, and a plurality of terminals retained in the passageways. Each terminal includes a contact portion exposed in the slot for contacting with the electronic card, and a deformable resilient beam having a depressible portion away from the contact portion. The depressible portions are outwardly deflected and cause a rotation of the contact portions toward the electronic card, when electronic card is inserted in. The depressible portions are relaxed inwardly and cause a rotation of the contact portions beyond the electronic card when electronic card is extracted.

The contact portions of the terminals could rotate toward the electronic card, for establishing a reliable engagement between the contact portions and the electronic card. The contact portions could also rotate outwardly for releasing the electronic card, to thereby ease the extraction of the electronic card. The terminals are durable since the contact portions apply a gradually increasing amount of normal force when the electronic card is fully inserted. It is of further benefit that the mating interface of the terminals rotate with respect to the conductive pads of the electronic card. In so doing, the wear area is distributed across a larger portion of the terminal interface. Durability and reliability are thus further improved.

Other objects, advantages and novel features of the invention will become more apparent from the following detailed description of a preferred embodiment when taken in conjunction with the accompanying drawings.

BRIEF DESCRIPTION OF THE DRAWINGS

FIG. 1 is an assembled perspective view of a card connector assembly in accordance with the present invention, when an electronic card is not inserted in;

DETAILED DESCRIPTION OF THE INVENTION

Figure 1:
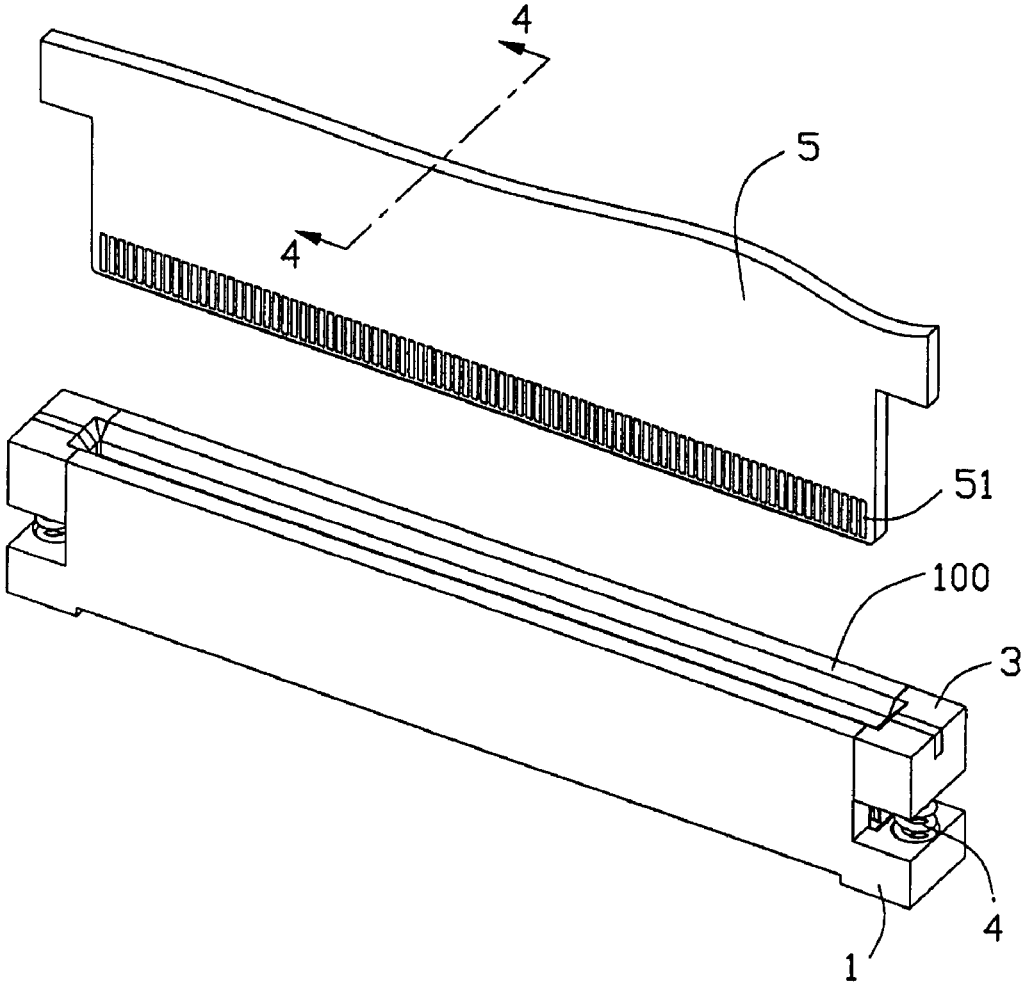

Reference will now be made to the drawing figures to describe the present invention in detail. Referring to FIGS. 1-6, a card connector assembly 100 in accordance with the preferred embodiment of the present invention is adapted for insertion of an electronic card 5. The card connector assembly 100 comprises an insulative housing 1, a plurality of terminals 2 assembled to the insulative housing 1, a carriage component 3, and a pair of coil springs 4 compressed between the carriage component 3 and the insulative housing 1.

Figure 2:
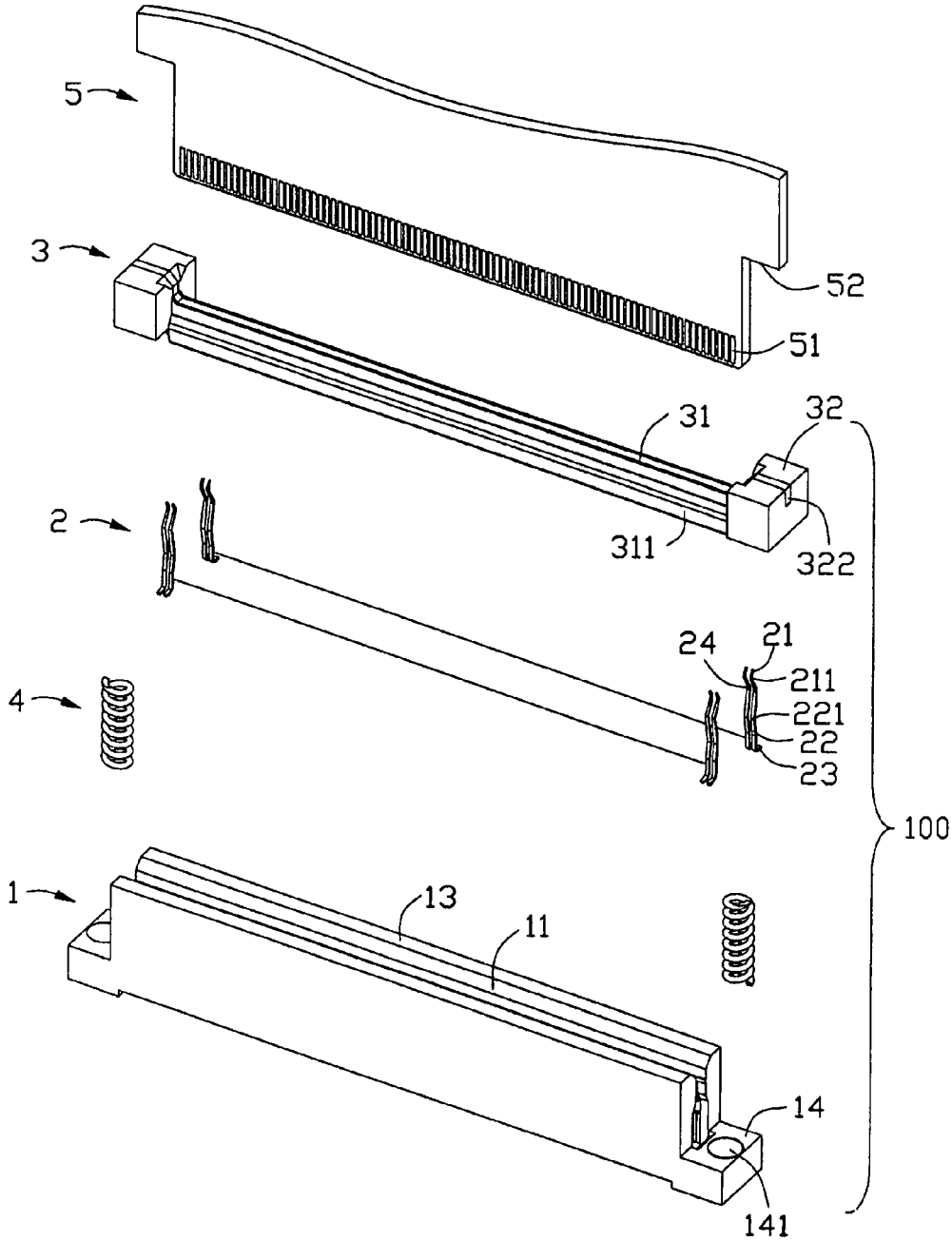
FIG. 2 is an exploded perspective view of the card connector assembly together with the electronic card, as shown in FIG. 1.
Figure 3:
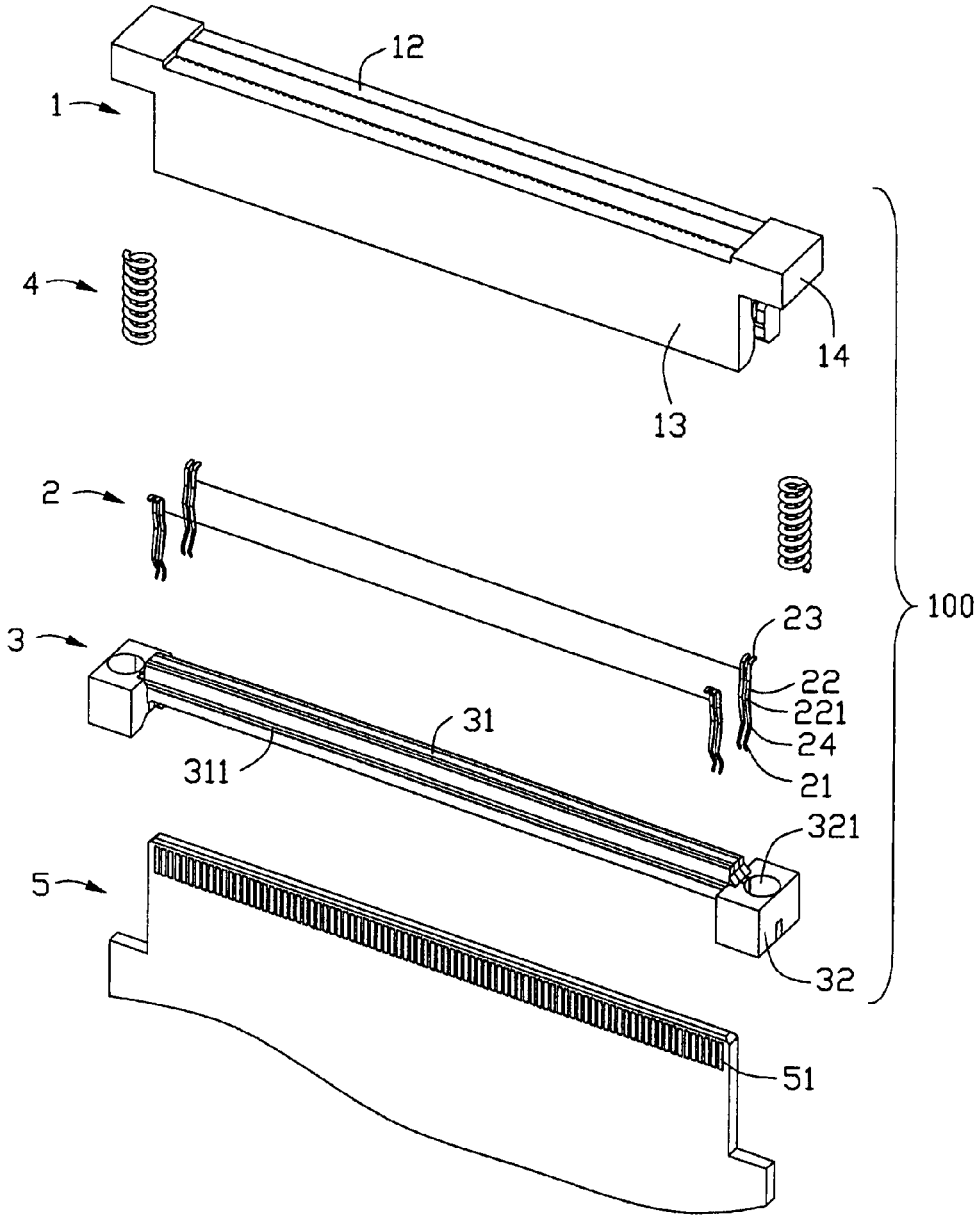
FIG. 3 is an exploded perspective view similar to FIG. 2, taken from another aspect.
Figure 4:
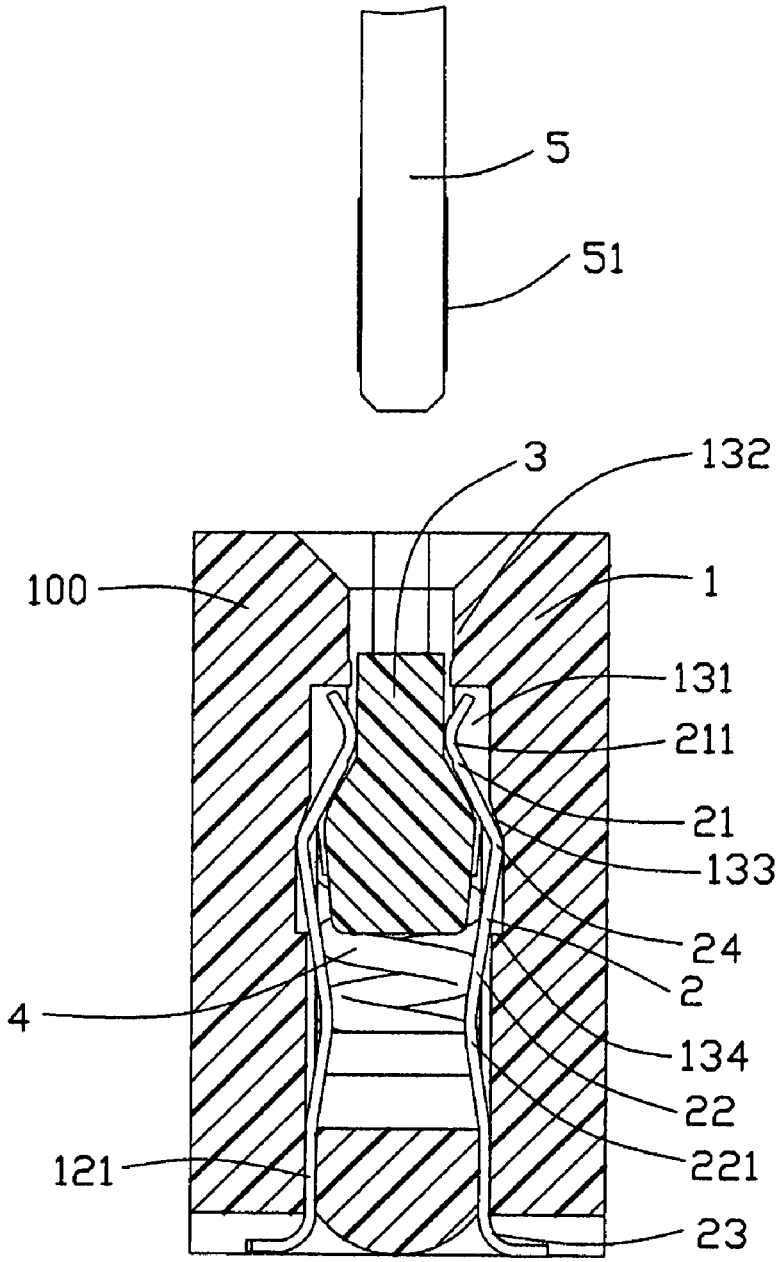
FIG. 4 is a cross-sectional view of the card connector assembly as shown in FIG. 1, taken along line 4-4, when the electronic card is not inserted therein.
Figure 5:
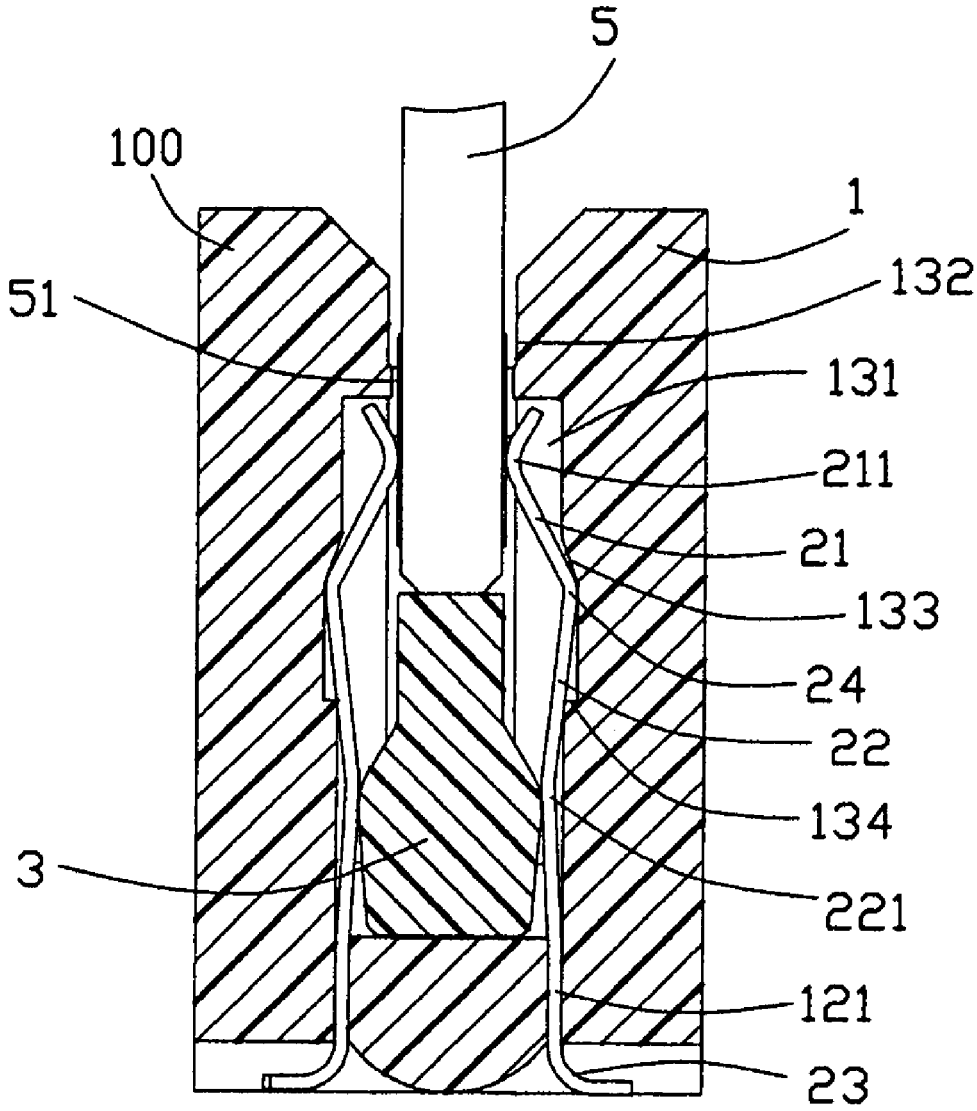
FIG. 5 is a cross-sectional view of the card connector assembly as shown in FIG. 1, taken along line 4-4, when the electronic card is fully inserted therein.
Figure 6:
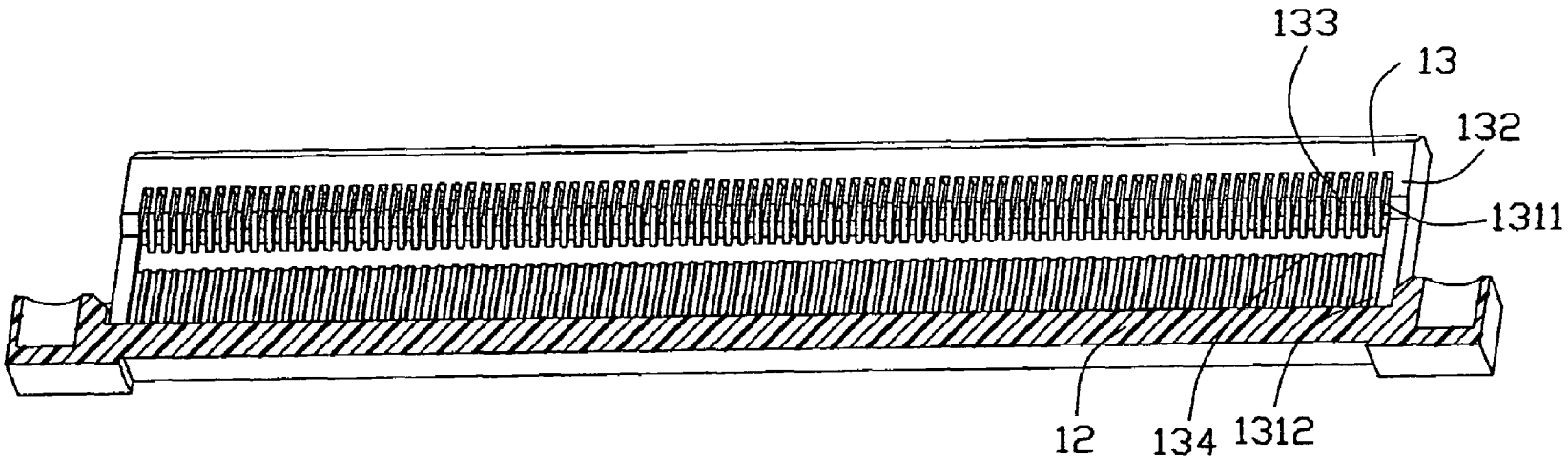
FIG. 6 is a perspective view showing a periphery wall of the card connector assembly.

Referring to FIGS. 2, 3, the insulative housing 1 comprises a rectangular base portion 12, a pair of periphery walls 13 upstanding from opposite sides of the base portion 12 and spaced apart from each other, an elongated slot 11 defined between the pair of separated periphery walls 13 and exposed to the outside in a longitudinal direction, and a pair of ear portions 14 projecting outwardly from opposite ends of the base portion 12. The periphery walls 13 have a plurality of passageways 131 defined in inner faces thereof along a top-to-bottom direction and communicating with the slot 11 for insertion of the terminals 2. Referring to FIGS. 4-6, each periphery wall 13 has a protrusion 132 projecting toward the slot 11 from an upper portion thereof. Each passageway 131 comprises an upper passageway 1311 defined in an inner surface of the protrusion 132, and a lower passageway 1312 preferably aligning with corresponding upper passageway 1311. The periphery wall 13 has a retention portion 133 molded in each upper passageway 1311, and a stepped portion 134 formed in each lower passageway 1312.

The base portion 12 defines thereon a plurality of channels 121 communicating with corresponding lower passageways 1312 and extending throughout the base portion 12 in a top-to-bottom direction. Each ear portion 14 has a circular receiving hole 141 defined on an upper surface thereof for fixing the coil spring 4.

Each terminal 2 comprises a deformable resilient beam 22 having a depressible portion 221 bended inwardly from a middle portion of the resilient beam 22, a bending portion 24 bended inwardly from an upper end of the resilient beam 22, a contact portion 21 inflecting inwardly from bending portion 24 and having an angled contact end 211, and a soldering portion 23 generally perpendicular to a lower end of the resilient beam 22. Understandably, the depressible portions 221 bended outwardly or formed straight are also applicable, if only they could be depressed outwardly by the carriage component 3.

The carriage component 3 comprises an elongated insertion portion 31 having a pair of angled side faces 311, and a pair of projecting ear portions 32 formed at opposite ends of the insertion portion 31. The projecting ear portion 32 surrounds the ends of a stiffening member 322 which extends the length of the carriage component 3. There is also an engaging hole 321 defined on a lower surface thereof for partially retaining the spring 4.

The electronic card 5 has a plurality of conductive pads 51 formed along a lower edge thereof, and a pair of projections 52 projecting laterally from opposite edges thereof.

Referring to FIG. 4, in conjunction with FIG. 1, in assembly of the card connector assembly 100, the terminals 2 are mounted in the insulative housing 1, with the resilient beams 22 inserted into the lower passageways 1312, and the contact portions 21 retained in the upper passageways 1311 and partially exposed within the slot 11. The bending portions 24 of the terminals 2 resist against lower portions of the retention portions 133. The resilient beams 22 resist against the stepped portions 134 of the insulative housing 1. The soldering portions 23 extend outwardly through the channels 121 for soldering onto a circuit board (not shown).

The insertion portion 31 of the carriage component 3 is retained within the slot 11 and is moveable between the protrusions 132 and the base portion 12 along a top-to-bottom direction. The protrusions 132 project toward the slot 11 for resisting a disengagement of the insertion portion 31 away from the slot 11. The projecting ear portions 32 of the carriage component 3 are exposed outside of the slot 11 and abut against side surfaces of the periphery walls 13 of the insulative housing 1, with the engaging holes 321 being opposite to corresponding receiving holes 141 of the ear portions 14. The pair of coil springs 4 are assembled between projecting ear portions 32 of the carriage component 3 and the ear portions 14 of the insulative housing 1, with opposite ends thereof respectively retained in the engaging holes 321 and the receiving holes 141.

Referring to FIG. 4, in conjunction with FIG. 1, when the electronic card 5 is not inserted into the card connector assembly 100, the carriage component 3 is upheld by the springs 4. A top surface of the projecting ear portions 32 is relatively flush with a top surface of the periphery walls 13. A bottom face of the insertion portion 31 is positioned above the depressible portions 221 of the terminals 2. A distance between the depressible portions 221 of two opposite terminals 2 is smaller than that between the pair of side faces 311 of the carriage component 3.

In operation, once exerting an external force on the electronic card 5, the electronic card 5 is inserted into the slot 11 in a top-to-bottom direction to push the carriage component 3 downwardly. Referring to FIG. 5, in conjunction with FIG. 3, when the carriage component 3 moves downwardly to contact with the resilient beams 22 of the terminals 2, the depressible portions 221 are depressed outwardly by the angled side faces 311 of the carriage component 3. The contact portions 21 rotate inwardly around the stepped portion 134 to permit the contact ends 211 of the terminals 2 to come to contact with the conductive pads 51 of the electronic card 5. Along with a further insertion of the electronic card 5, the angled side faces 311 continue to depress the depressible portions 221 more outwardly, to thereby force the contact ends 211 to rotate more inwardly to clamp the conductive pads 51 tightly. The carriage component 3 reaches the base portion 12 of the insulative housing 1 finally when the electronic card 5 is fully inserted in the slot 11.

When the electronic card 5 is extracted from the electrical connector assembly 100, the carriage component 3 returns backwardly under a restorative force provided by the compressed springs 4. The depressible portions 221 of the contacts 2 stand against the angled side faces 311 and encourage the carriage component 3 together with the electronic card 5 upward. Simultaneously, the depressible portions 221 are relaxed inwardly and cause the contact portions 21 to rotate outwardly around the stepped portions 134 for loosening the electronic card 5, and thereby to ease the return of the carriage component 3 together with the extraction of the electronic card 5.

Optionally, when the carriage component 3 needs to be removed for simplifying the configuration of the card connector assembly 100, the depressible portions 221 of the terminals 2 are disposed at an insertion position of the electronic card 5 for being depressed outwardly by the inserted electronic card 5 directly to then have the regular deformation. During such a process, the springs 4 are compressed between the electronic card 5 and the ear portion 14 of the insulative housing 1. The conductive pads 51 are formed at a proper portion of the electronic card 5 for engaging with the contact ends 211 of the inwardly rotated contact portions 21 of the terminals 2.

However, the disclosure is illustrative only, changes may be made in detail, especially in matter of shape, size, and arrangement of parts within the principles of the invention.

What is claimed is:

1. A card connector assembly for insertion of an electronic card, comprising: an insulative housing defining therein a slot and a plurality of passageways communicating with the slot; and a plurality of terminals retained in the passageways, each terminal comprising a contact portion exposed in the slot for contacting with the electronic card, and a deformable resilient beam having a depressible portion away from the contact portion; wherein the depressible portions of the terminals are outwardly deflected due to an insertion of the electronic card, and are inwardly relaxed due to an extraction of the electronic card, wherein the depressible portions are deflected outwardly and cause an inward rotation of the contact portions for engaging with the electronic card, wherein each passageway of the insulative housing has a stepped portion formed therein, wherein the resilient beam resists against the stepped portion and the contact portion is rotatable around the stepped portion, wherein a carriage component has a pair of angled side faces outwardly depressing the depressible portions of the terminals when the carriage component is moved downwardly together with the electronic card, and wherein the depressible portions of the terminals stand against the angled side faces and encourage the carriage component upward, as the carriage component is returning to the initial position.

2. The card connector assembly as claimed in claim 1, wherein said depressible portion bends inwardly from a middle portion of each resilient beam of the terminal.

3. The card connector assembly as claimed in claim 1, wherein each passageway comprises an upper passageway for receiving the contact portion and a lower passageway for receiving the resilient beam, and wherein said stepped portion is formed within the lower passageway.

4. The card connector assembly as claimed in claim 1, wherein said insulative housing comprises a pair of upstanding periphery walls spaced apart from each other for defining the slot there between, and a carriage component having an insertion portion extending within the slot.

5. The card connector assembly as claimed in claim 4, wherein each periphery wall has a protrusion projecting toward the slot for resisting a disengagement of the insertion portion away from the slot.

6. The card connector assembly as claimed in claim 4, wherein said insulative housing is formed with at least an ear portion, and the carriage component is formed with at least a projecting ear portion exposed outside the slot, said spring is confined between the ear portion and the projecting ear portion.

7. The card connector assembly as claimed in claim 6, wherein said ear portion and the projecting ear portion respectively defines a receiving hole and an engaging hole opposite to said receiving hole, and wherein said spring has opposite ends respectively received in the receiving hole and the engaging hole.

8. A card connector assembly for insertion of an electronic card, comprising:

an insulative housing defining therein a slot and a plurality of passageways communicating with the slot; and a plurality of terminals retained in the passageways, each terminal comprising a contact portion exposed in the slot for contacting with the electronic card, and a deformable resilient beam having a depressible portion away from the contact portion; and a carriage component moveable along with the electronic card, at least a spring assembled between the carriage component and the insulative housing for restoring the carriage component upwardly to an initial position; wherein downward movement of the carriage component due to downward movement of the electronic card, results in outward deflection of the depressible portion which causes an inward rotation of the contact portion for engagement with the electronic card.

* * * * *